United States Patent [19]

Tanabe

[11] Patent Number: 5,042,578

[45] Date of Patent: Aug. 27, 1991

[54] HEAT EXCHANGER

[75] Inventor: Kenichi Tanabe, Takasaki, Japan

[73] Assignee: Sanden Corporation, Gunma, Japan

[21] Appl. No.: 507,446

[22] Filed: Apr. 11, 1990

[30] Foreign Application Priority Data

Apr. 11, 1989 [JP] Japan ..... 1-41654[U]

[51] Int. Cl.[5] ..... F28F 9/22; F28F 9/02

[52] U.S. Cl. ..... 165/174; 165/176

[58] Field of Search ..... 165/176, 174

[56] References Cited

U.S. PATENT DOCUMENTS

| | | | |
|---|---|---|---|
| 230,815 | 8/1880 | Puffer . | |
| 2,867,416 | 1/1959 | Lieberherr . | |
| 4,206,805 | 6/1980 | Beckett | 165/176 |
| 4,825,941 | 5/1989 | Hoshino et al. | 165/176 |
| 4,936,381 | 6/1990 | Alley | 165/176 |

FOREIGN PATENT DOCUMENTS

| | | |
|---|---|---|
| 1265756 | 5/1961 | France . |
| 63-112065 | 5/1988 | Japan . |
| 63-113300 | 5/1988 | Japan . |

*Primary Examiner*—Albert W. Davis, Jr.
*Attorney, Agent, or Firm*—Banner, Birch, McKie & Beckett

[57] ABSTRACT

A heat exchanger for use in an automobile air conditioning system is disclosed. A condenser as the heat exchanger comprises a plurality of flat tubes for conducting refrigerant and a plurality of corrugated fins fixedly sandwiched between the flat tubes. First and second cylindrical header pipes are fixedly and hermetically connected to the interior of the flat tubes, and are provided with inlet and outlet union elements respectively for connecting the condenser to the other elements of the air conditioning system. Each of the header pipes is provided with a partition plate in order to turn the direction of the flow of the refrigerant, thereby obtaining the effective heat exchangeability of the condenser. The partition plate includes large and small semicircular portions. A semicircular slot is formed at a certain portion of each of the header pipes in order to place an arcuate periphery of the large semicircular portion on a lower surface thereof. A semicircular groove is formed at an inner peripheral surface of each of the header pipes opposite to the slot in order to place an arcuate periphery of the small semicircular portion on a lower side surface of the groove. Accordingly, even when the condenser receives an external impact in an assembling process thereof, an undesirable inclination of the partition plate can be prevented. Thereby, the partition plate can be fixedly disposed within the header pipe to prevent communication between upper and lower sections within the header pipe and leakage of refrigerant from the condenser to the atmosphere.

30 Claims, 7 Drawing Sheets

HEAT EXCHANGER

BACKGROUND OF THE INVENTION

1. Field of the Invention

The present invention relates to a heat exchanger, and more particularly, to a heat exchanger for use in an automobile air conditioning system.

2. Description of the Prior Art

With reference to FIG. 1, a conventional refrigeration circuit for use, for example, in an automotive air-conditioning system is shown. Circuit 1 includes compressor 10, condenser 500, receiver or accumulator 30, expansion device 40, and evaporator 50 serially connected through pipe member 60 which link the outlet of one component with the inlet of a successive component. The outlet of evaporator 50 is linked to the inlet of compressor 10 through pipe member 60 so as to complete the circuit. The length of pipe members 60 to each component of circuit 1 are made such that the circuit is hermetically sealed.

In operation of circuit 1, refrigerant gas is drawn from the outlet of evaporator 50 and flows through the inlet of compressor 10, and is compressed and discharged to condenser 500. The compressed refrigerant gas in condenser 500 radiates heat to an external fluid flowing through the condenser 500, for example, atmospheric air, and condenses to the liquid state. The liquid refrigerant flows to receiver 30 and is accumulated therein. The refrigerant in receiver 30 flows to expansion device 40, for example, a thermostatic expansion valve, where the pressure of the liquid refrigerant is reduced. The reduced pressure liquid refrigerant flows through evaporator 50, and is vaporized by absorbing heat from a fluid flowing through the evaporator, for example, atmospheric air. The gaseous refrigerant then flows from evaporator 50 back to the inlet of compressor 10 for further compression and recirculation through circuit 1.

The condenser 500 which is shown in FIG. 1(*a*), comprises a heat exchanger 100 formed of a plurality of adjacent, essentially flat tubes 11 having an oval cross-section and open ends which allow refrigerant fluid to flow therethrough. A plurality of corrugated fin units 12 are disposed between adjacent tubes 11. Flat tubes 11 and fin units 12 jointly form the heat exchanger 100. Cylindrical header pipes 530, 540 are disposed perpendicularly to flat tubes 11 and may have, for example, a clad construction.

As shown in FIGS. 3 and 4, each header pipe 530, 540 includes an outer tube 13 which may be made from aluminum and an inner tube 14 made of a metal material which is brazed to the inner surface of outer tube 13. The outer tube 13 is provided with a plurality of first openings 15. The flat tubes 11 are fixedly connected to the header pipes 530, 540 and are disposed in openings 15 such that the open ends of the flat tubes 11 communicate with the hollow interior of header pipes 530, 540. Inner tube 14 includes portions 14*a* which define openings corresponding to openings 15. Portions 14*a* are brazed to the inner ends of flat tubes 11 and ensure that tubes 11 are hermetically sealed within header pipes 530, 540 when inserted in openings 15.

Returning again to FIG. 1(*a*) and 2, header pipe 530 has an open top end and a closed bottom end. The open top end is provided with an L-shaped pipe member 533*a* of which one end is fixedly and hermetically connected thereto. The other end of L-shaped pipe member 533*a* is sealed by an inlet union joint 533*b* which is fixedly and hermetically connected thereto. Inlet union joint 533*b* is linked to an outlet of the compressor 10 through a pipe member 60. The inlet union joint 533*b* and the L-shaped pipe member 533*a* jointly form an inlet union joint assembly 533. Second header pipe 540 has a closed top end and an open bottom end. The open bottom end is provided with an L-shaped pipe member 543*a* of which one end is fixedly and hermetically connected thereto. The other end of L-shaped pipe member 543*a* is sealed by an outlet union joint 543*b* which is fixedly and hermetically connected thereto. Outlet union joint 543*b* is liked to an inlet of the receiver-dryer 30 through a pipe member 60. The outlet union joint 543*b* and the L-shaped pipe member 543*a* jointly form an outlet union joint assembly 543.

Partition plate 200 is fixedly and fluid-tightly disposed within first header pipe 530 at a location about midway along its length and divides header pipe 530 into an upper section 531 and a lower section 532 which is isolated from the upper section 531. Partition plate 300 is fixedly and fluid-tightly disposed within second header pipe 540 at a location approximately one-third of the way along the length of second header pipe 540 and divides the second header pipe 540 into an upper section 541 and a lower section 542 which is isolated from the upper section 541. The location of partition plate 300 is lower than the location of partition plate 200.

With reference to FIGS. 6(*a*)–6(*d*) and 7, partition plates 200 and 300 are fixedly and fluid-tightly disposed within header pipes 530 and 540, respectively by the following manner. Since partition plates 200 and 300 are similarly configured, hereinafter, only partition plate 300 is discussed for purposes of illustration. As shown in FIG. 7, partition plate 300 includes a large semicircular portion 301 and a small semicircular portion 302, thereby forming a pair of shoulders 303. The radius of the large semicircular portion 301 is similar to the radius of an outer peripheral surface of header pipe 540, and the radius of small semicircular portion 302 is similar to the radius of an inner peripheral surface of header pipe 540. Semicircular slot 544 is formed at a certain portion of the header pipe 540. The height of the slot 544 is larger than the thickness of the partition plate 300 in order to easily pass the partition plate 300 therethrough. Partition plate 300 is inserted into the hollow interior of header pipe 540 through slot 544 in the direction shown by the arrow "Y" until an arcuate surface of small semicircular portion 302 contacts the inner peripheral surface of header pipe 540. However, the remainder of slot 544 develops an axial air gap 544*a*. After insertion of partition plate 300 into the hollow interior of header pipe 540, the arcuate periphery of large semicircular portion 301 of partition plate 300 is brazed to the inner peripheral surface of header pipe 540, and the arcuate surface of small semicircular portion 302 of partition plate 300 is brazed to the inner peripheral surface of header pipe 540.

In operation, compressed refrigerant gas from the compressor flows into upper section 531 of first header pipe 530 through inlet union joint assembly 533, and is distributed such that a portion of the gas flows through each of the flat tubes 11 which is disposed above the location of partition plate 200, and into an upper portion of upper section 541. Thereafter, the refrigerant in the upper portion of section 541 flows downwardly into a lower portion of upper section 541, and is distributed such that a portion flows through each of the plurality of flat tubes 11 disposed below the location of partition plate 200 and above the location of partition plate 300, and into an upper portion of lower section 532 of first header pipe 530. The refrigerant in the upper portion of lower section 532 flows downwardly into a lower portion of lower section 532, and is again distributed such that a portion flows through each of the plurality of flat tubes 11 disposed below the location of partition plate 300, and into the lower section 542 of second header pipe 540. As the refrigerant gas sequentially flows through the flat tubes 11, heat from the refrigerant gas is exchanged with the atmospheric air flowing through corrugated fin units 12 in the direction of arrow "W" as shown in FIG. 5. Since the refrigerant gas transfers heat to the outside air, it condenses to the liquid state as it travels through the tubes 11. The condensed liquid refrigerant in the lower section 542 flows through the outlet union joint assembly 543 and into the receiver-dryer 30.

However, in the prior art, only an arcuate periphery of large semicircular portion 301 is placed on a lower end surface 544*b* of slot 544. Consequently, if the condenser 500 receives an external impact in an assembling process thereof, then the partition plate 300 may be undesirably inclined with an angle which is determined by the size of the axial air gap 544*a*. With reference to FIGS. 8 and 9, when partition plate 300 is brazed to the inner peripheral surface of header pipe 540 without eliminating the undesirable inclination thereof, cavities 545 and 546 may be created in a substantial brazing portion 14*b*. The cavity 546 allows the undesirable communication between upper and lower cavities 541 and 542 of the header pipe 540, thereby decreasing the heat exchangeability of the condenser 500. Furthermore, the cavity 545 allows undesirable communication between the lower section 542 of header pipe 540 and the atmosphere, thereby causing leakage of the refrigerant from the condenser 500.

SUMMARY OF THE INVENTION

Accordingly, it is an object of the present invention to provide a condenser in which a partition plate is disposed within the header pipes without an undesirable inclination thereof so as to prevent undesirable communication between the upper and lower sections of the header pipes and undesirable communication between the sections of the header pipes and the atmosphere. A condenser for a refrigerant fluid circuit comprises a plurality of tubes having opposite first and second open ends. A plurality of fin units are disposed between the plurality of tubes. The first and second header pipes are fixedly and hermetically disposed at the opposite ends of the tubes, respectively. The open ends of the tubes are disposed in fluid communication with the interior of the header pipes. The header pipes are provided with at least one partition plate inserted into the interior thereof. A part of the periphery of the partition plate is received at a lower end surface of one slot when the partition plate is completely inserted into the interior of the header pipes. The partition plate divides the tubes into at least two groups of tubes having first and second groups of tubes. The first group of tubes provides a fluid communication between the first and second header pipes so as to conduct the refrigerant into the condenser from an external element of the circuit. The second group of tubes provides a fluid communication between the first and second header pipes so as to conduct the refrigerant into another external element of the circuit from the condenser. The header pipes include a supporting portion formed at an inner surface of the header pipes opposite to the slot so as to support another part of the periphery of the partition plate opposite to the part of the periphery of the partition plate.

The invention also provides a refrigerant circuit comprising a compressor, a condenser, an expansion element, and an evaporator sequentially disposed. The condenser comprises first and second header pipes and a heat exchanging region. The header pipes have a partition plate inserted therein which is partially supported by a slot formed in a side surface of the header pipe and partially supported by a supporting portion formed at an inner surface of the header pipe opposite to the slot.

Furthermore, the invention provides a header pipe for a heat exchanger in a refrigerant fluid circuit comprising a slot formed in the side surface of the header pipe. A supporting portion is formed at an inner surface of the header pipe. A partition plate which is inserted into the slot is simultaneously supported by the slot and the supporting portion.

BRIEF DESCRIPTION OF THE DRAWINGS

FIG. 1(*a*) is an elevational view of a condenser in accordance with the prior art.

FIG. 6(*b*) is a cross-sectional view taken along line 6(*b*)—6(*b*) in FIG. 6(*a*) with the partition plate omitted.

FIG. 6(*c*) is a cross-sectional view of the partition plate omitted in FIG. 6(*b*).

FIG. 6(*d*) is a cross-sectional view taken along line 6(*d*)—6(*d*) in FIG. 6(*a*).

FIG. 10(*b*) is a view similar to FIG. 6(*b*) illustrating the cross-sectional view taken along line A—A in FIG 10(*a*) with the partition plate omitted.

FIG. 10(*c*) is a view similar to FIG. 6(*c*) illustrating a cross-sectional view of the partition plate omitted in FIG. 10(*b*).

FIG. 10(*d*) is a view similar to FIG. 6(*d*) illustrating a cross-sectional view taken along line B—B in FIG. 10(*a*).

FIG. 10(*e*) is a partial perspective view of the first embodiment of the present invention of FIG. 10(*a*) with flat tubes and fin units omitted.

FIG. 11(*b*) is a view similar to FIG. 6(*b*) illustrating the cross-sectional view taken along line D—D in FIG. 11(*a*) with the partition plate omitted.

FIG. 11(*c*) is a view similar to FIG. 6(*c*) illustrating a cross-sectional view of the partition plate omitted in FIG. 11(*b*).

FIG. 11(*d*) is a view similar to FIG. 6(*d*) illustrating the cross-sectional view taken along line C—C in FIG. 11(*a*).

DETAILED DESCRIPTION OF THE PREFERRED EMBODIMENTS

Figure 1:
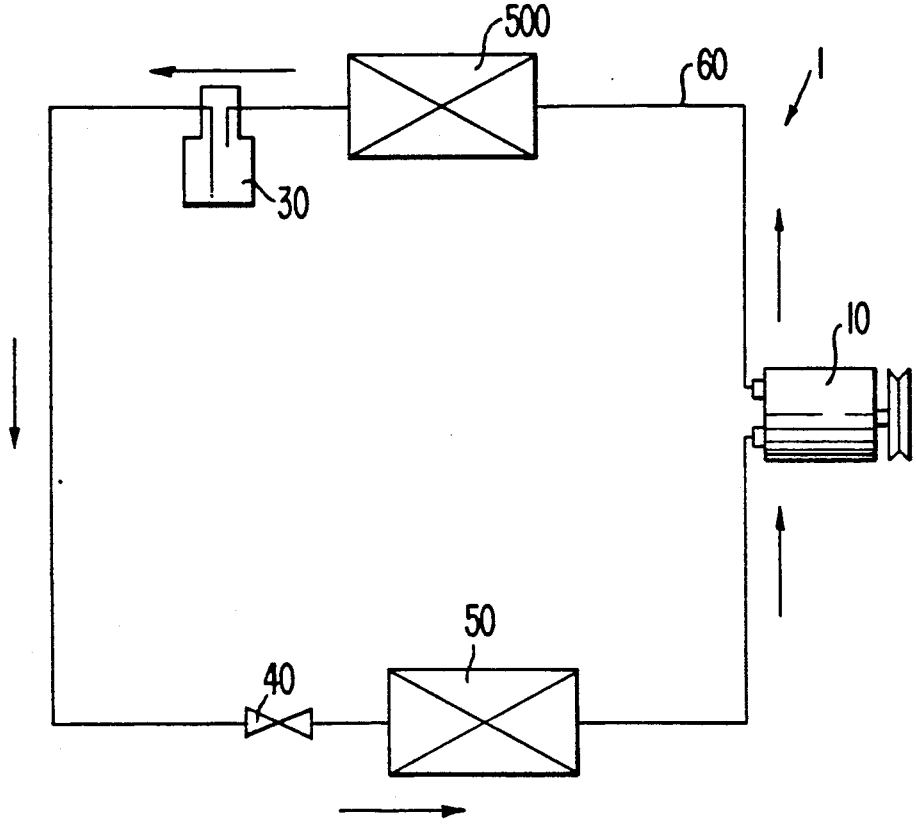
FIG. 1 (PRIOR ART)
FIG. 1 is a schematic block diagram of a refrigerant circuit in accordance with the prior art.
Figure 7:
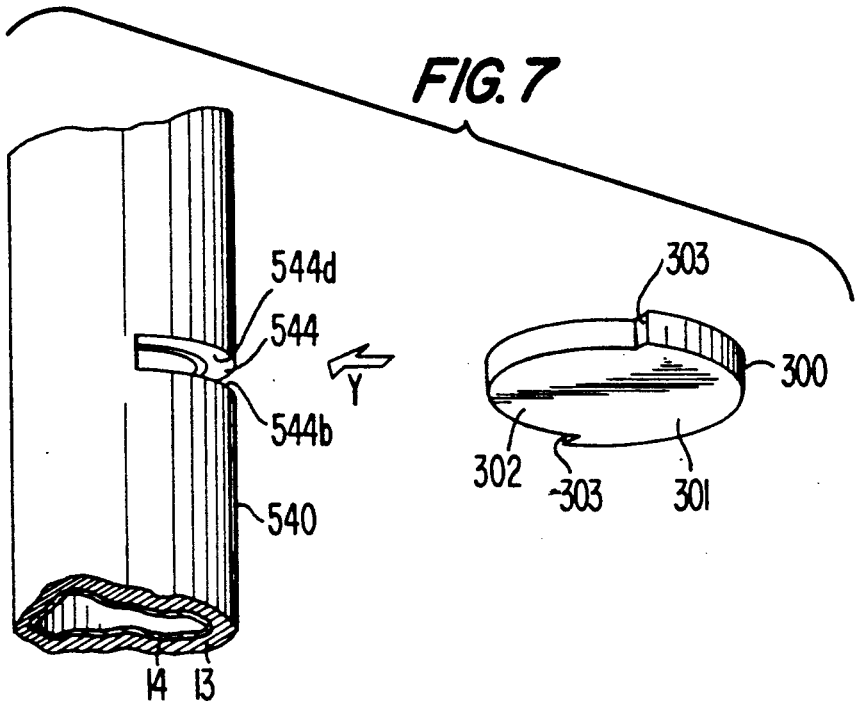
FIG. 7 is an exploded perspective view of the condenser of FIG. 6(*a*) with the flat tubes and fin units omitted.
Figure 1:
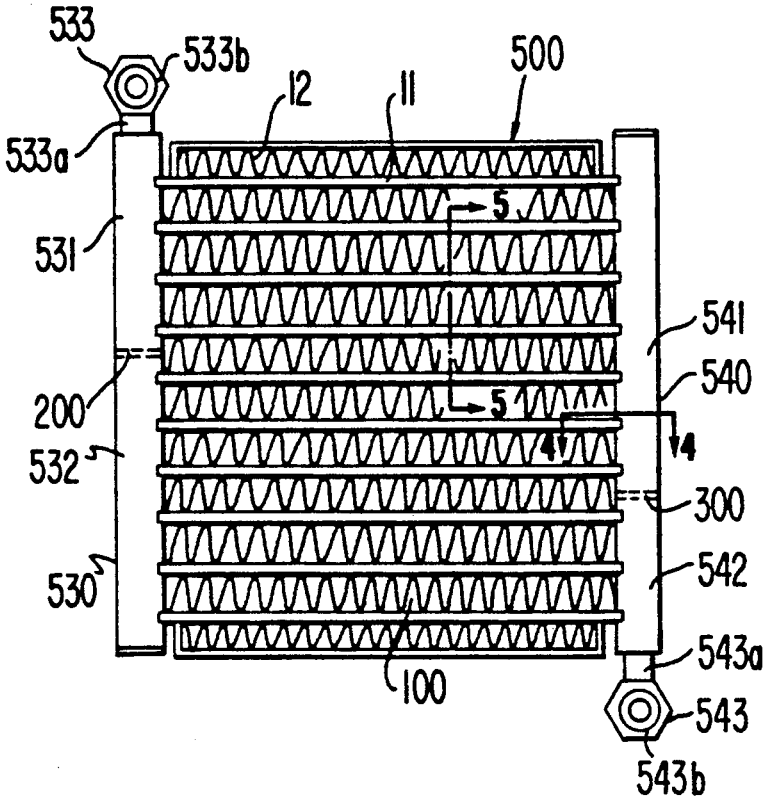
FIG. 1 (a) (PRIOR ART)
Figure 2:
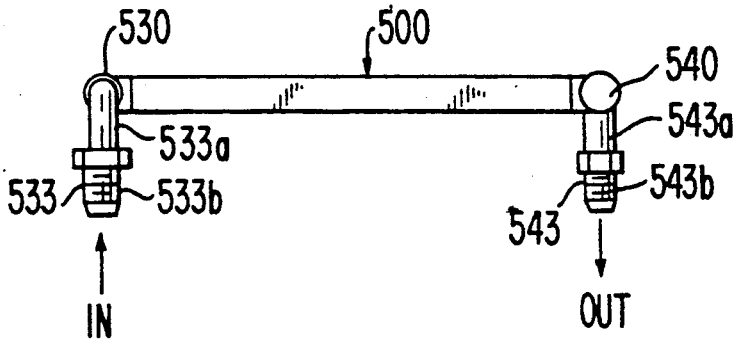
FIG. 2 (PRIOR ART)
FIG. 2 is a top view of the condenser shown in FIG. 1(*a*).
Figure 3:
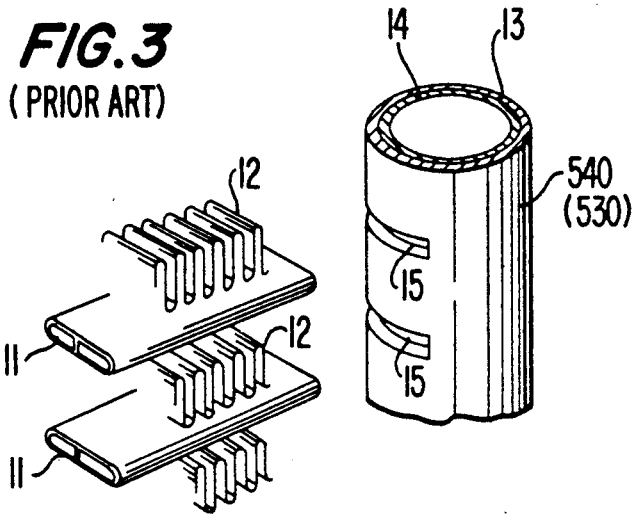
FIG. 3 (PRIOR ART)
FIG. 3 is a perspective view of certain elements of the condenser shown in FIG. 1(*a*).
Figure 4:
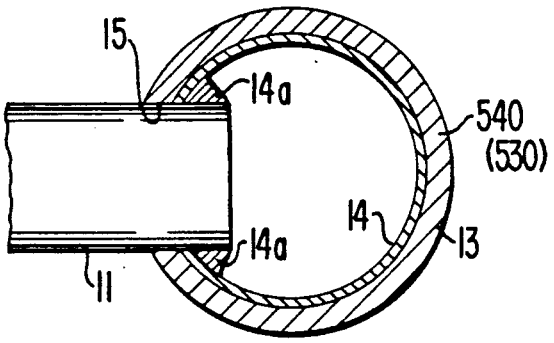
FIG. 4 (PRIOR ART)
FIG. 4 is a partial cross-section along line 4—4 in FIG. 1(*a*).
Figure 5:
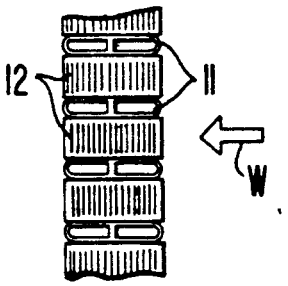
FIG. 5 is a partial cross-section along line 5—5 in FIG. 1(*a*).
Figure 6A:
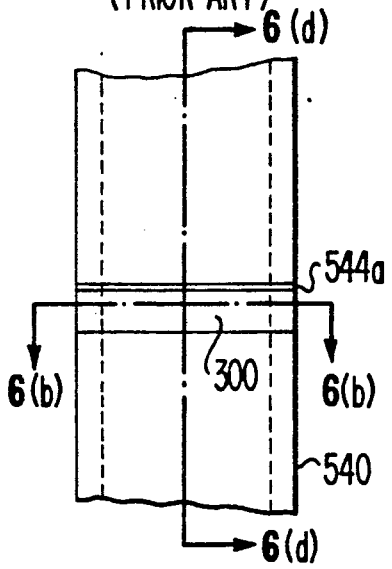
FIG. 6(a) (PRIOR ART)
FIG. 6(*a*) is a partial right side view of the condenser shown in FIG. 1(*a*).
Figure 6C:
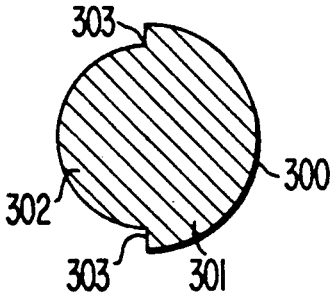
FIG. 6(c) (PRIOR ART)
Figure 6:
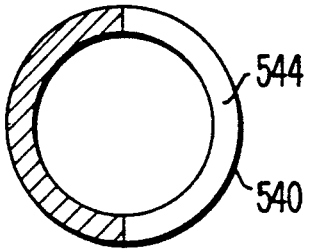
FIG. 6 (b) (PRIOR ART)
Figure 6:
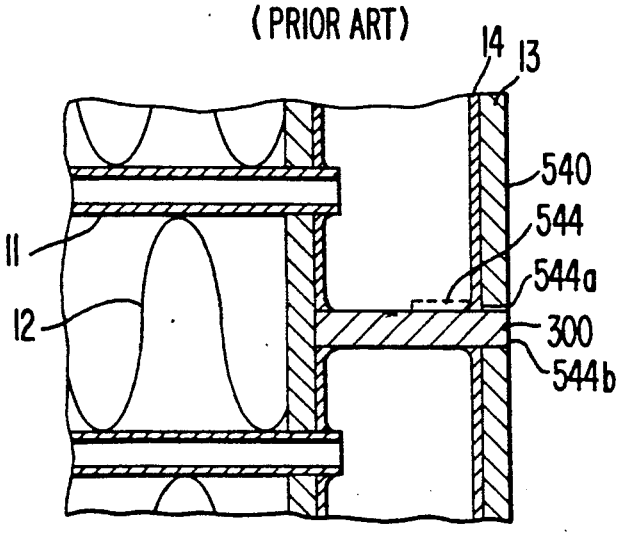
FIG. 6 (d) (PRIOR ART)
Figure 8:
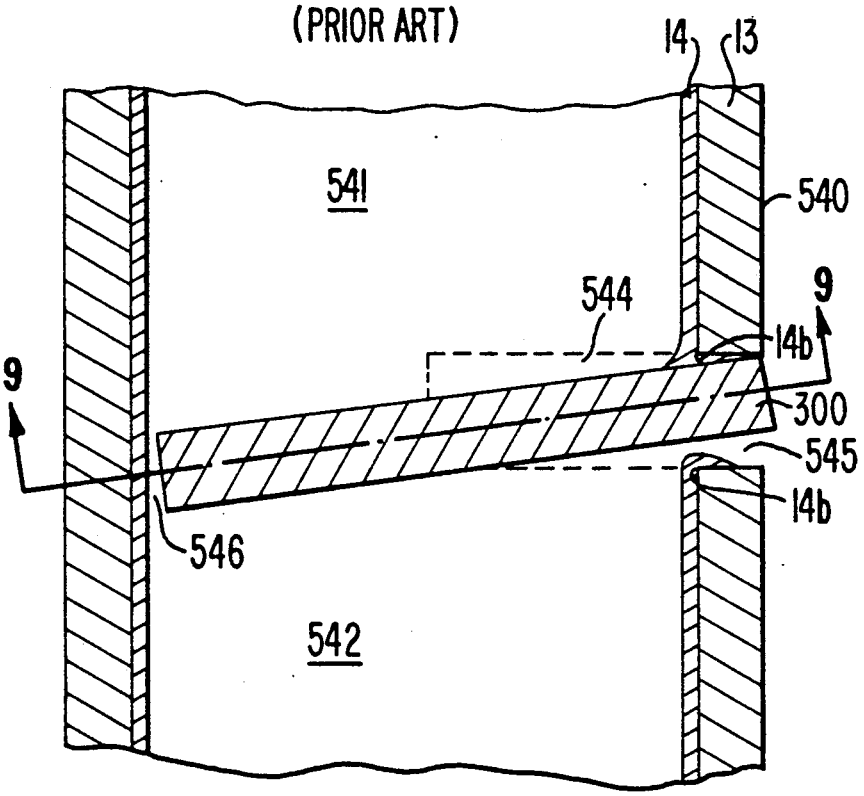
FIG. 8 (PRIOR ART)
FIG. 8 is an enlarged view similar to FIG. 6(*d*) with the flat tubes and fin units omitted.
Figure 9:
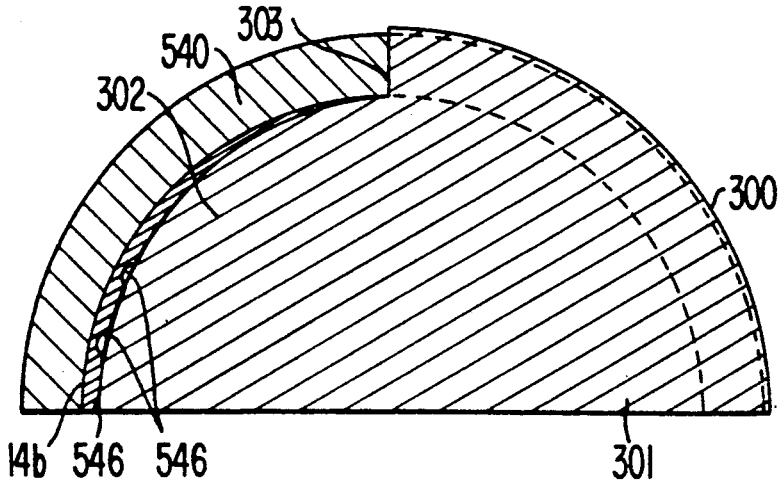
FIG. 9 (PRIOR ART)
FIG. 9 is a cross-sectional view taken along line 9—9 in FIG. 8.

In the preferred embodiments of the present invention, only a partition plate which is fixedly and fluid-tightly disposed with the second header pipe is discussed for purposes of illustration in the same manner as the prior art embodiment. Furthermore, in the drawings associated with the preferred embodiments, the same numerals are used to denote corresponding elements shown in FIGS. 1–9 so that substantial explanation thereof is omitted.

Figure 10:
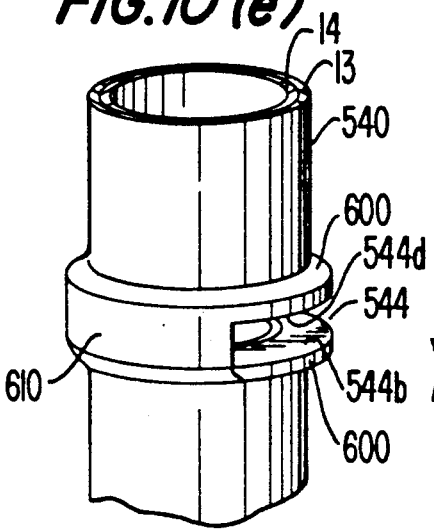
FIG. 10(*a*) is a view similar to FIG. 6(*a*) illustrating a right side view of a condenser in accordance with first embodiment of the present invention.
Figure 10A:
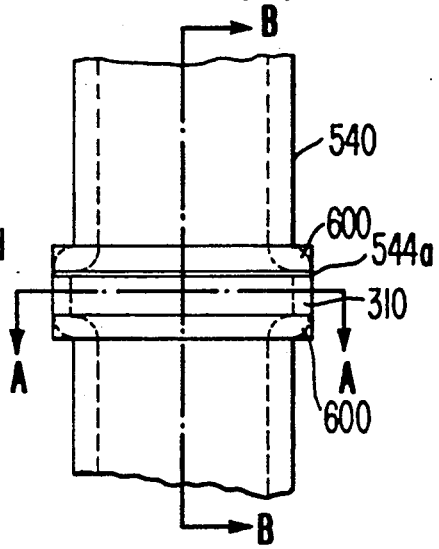
Figure 10C:
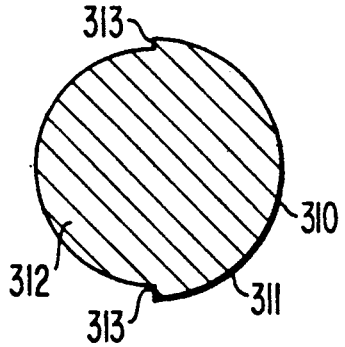
Figure 10B:
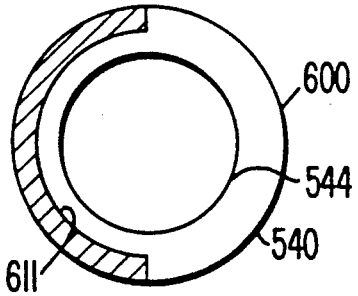
Figure 10:
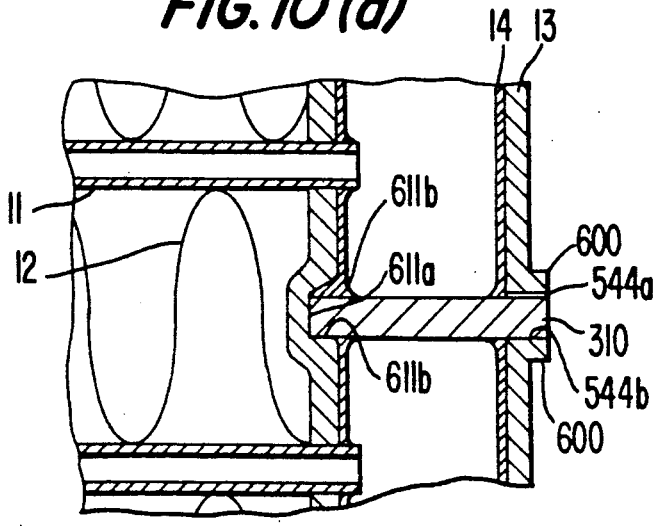
Figure 11A:
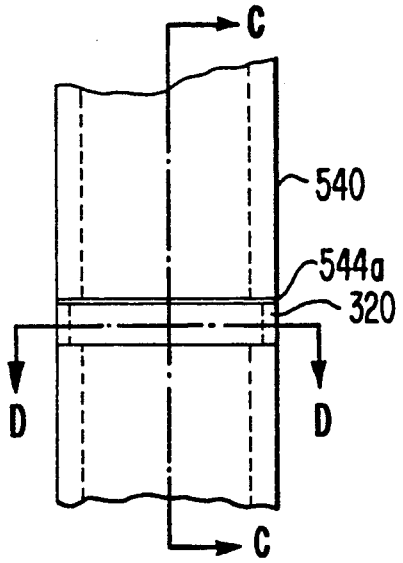
FIG. 11(*a*) is a view similar to FIG. 6(*a*) illustrating a right side view of a condenser in accordance with a second embodiment of the present invention.
Figure 11C:
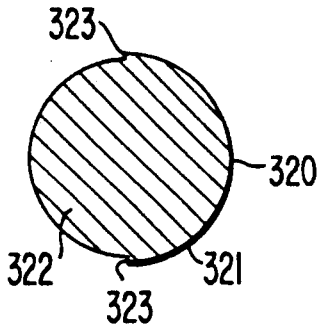
Figure 11B:
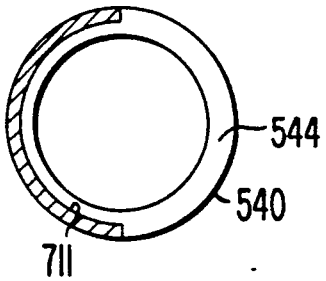
Figure 11D:
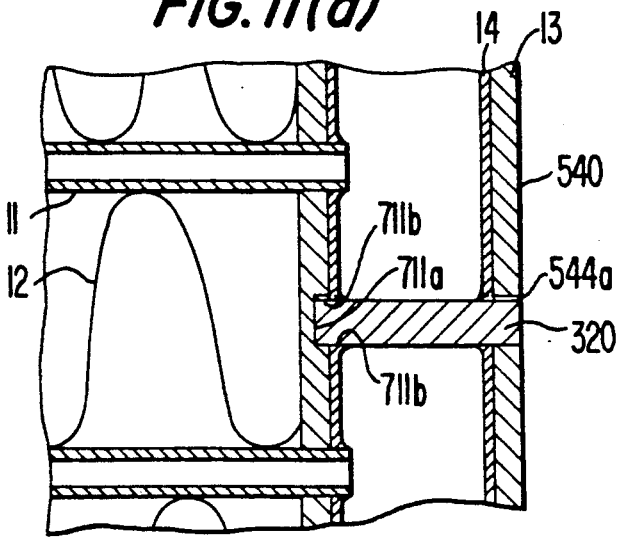

FIGS. 10(*a*)–10(*e*) show a certain portion of a condenser in accordance with a first embodiment of the present invention. With reference to FIGS. 10(*a*)–10(*e*), header pipe 540 is provided with a pair of semicircular flanges 600 formed along upper and lower end surfaces 544*d* and 544*b* of semicircular slot 544, respectively. Portion 610 of header pipe 540 circularly extending from semicircular flanges 600 is manufactured with a radial protrusion by using a circular die (not shown) made of steel so as to form semicircular groove 611 at the inner peripheral surface of the portion 610 of header pipe 540. The process of forming groove 611 is as follows. First, the circular die having a certain thickness and a certain radius is inserted into the hollow interior of header pipe 540 through slot 544. Then, the circular die is moved toward the inner peripheral surface of the portion 610 of header pipe 540 opposite to slot 544 in order to radially and outwardly protrude the portion 610 of header pipe 540 opposite to slot 544. Consequently, semi-circular groove 611 circularly extending from flanges 600 is smaller than the height of slot 544 and is slightly larger than the thickness of the partition plate 310, and the radius of the circular die is larger than the radius of an inner peripheral surface of header pipe 540.

Partition plate 310 includes a large semicircular portion 311 whose radius is similar to the radius of the outer peripheral surfaces of flanges 600 and a small semicircular portion 312 whose radius is similar to the radius of the above-mentioned circular die, thereby forming a pair of shoulders 313. Partition plate 310 is inserted into the hollow interior of header pipe 540 through slot 544 until an arcuate surface of small semi-circular portion 312 contacts the bottom surface 611*a* of groove 611. However, the slot 544 develops an axial air gap 544*a*. After inserting partition plate 310 into the hollow interior of header pipe 540, the arcuate periphery of large semicircular portion 311 of partition plate 310 is brazed to the inner peripheral surface of header pipe 540, and the arcuate periphery of small semicircular portion 312 of partition plate 310 is brazed to both side surfaces 611*b* of groove 611. Thus, the partition plate 310 is fixedly disposed within the header pipe 540 while fluid communication between the upper and lower sections 541, 542 through the partition plate 310 is prevented. Also, the heat exchanger is now hermetically sealed as refrigerant is prevented from escaping to the atmosphere.

In this embodiment, not only the arcuate periphery of the large semicircular portion 311 of partition plate 310 is placed on the lower end surface 544*b* of slot 544 but also the arcuate periphery of small semicircular portion 312 of partition plate 310 is placed on the lower side surface of groove 611. Accordingly, even when the condenser 500 receives an external impact in the assembling process thereof, an undesirable inclination of the partition plate 310 can be prevented. Therefore, the defective creation of cavities 545 and 546 in the header pipes 530, 540 is prevented. Accordingly, undesirable communication between upper 541 and lower 542 sections within the condenser 500 and leakage of refrigerant from the condenser 500 to the atmosphere are prevented.

Furthermore, due to providing semicircular flanges 600 along the upper and lower end surfaces 544*d* and 544*b*, semicircular slot 544 is substantially extended radially and outwardly. Therefore, the angle of inclination of partition plate 310 is decreased. Accordingly, an undesirable inclination of the partition plate 310 can be prevented more effectively.

FIGS. 11(*a*)–11(*d*) show a certain portion of a condenser in accordance with a second embodiment of the present invention. With reference to FIGS. 11(*a*)–11(*d*), semicircular groove 711 circularly extending from semicircular slot 544 is formed at the inner peripheral surface of the header pipe 540. The process of forming the groove 711 is as follows. First, a cutting tool (not shown) is inserted into the hollow interior of header pipe 540 through the open bottom end of header pipe 540 before connecting the L-shaped pipe member 543*a* to the open bottom end of header pipe 540. Then, the inner peripheral surface of the header pipe 540 is machined to form the semicircular groove 711 using a lathe, for example. Preferably, the height of groove 711 is smaller than the height of the slot 544 and is slightly larger than the thickness of the partition plate 320. Also, the radius of the groove 711 is larger than the radius of the inner peripheral surface of the header pipe 540.

The partition plate 320 includes a large semicircular portion 321 whose radius is similar in size to the radius of the outer peripheral surface of header pipe 540. The partition plate 320 also includes a small semicircular portion 322 whose radius is similar in size to the radius of bottom surface 711*a* of groove 711, thereby the partition plate forms a pair of shoulders 323. Partition plate 320 is inserted into the hollow interior of header pipe 540 through slot 544 until the arcuate surface of small semicircular portion 322 contacts the bottom surface 711*a* of groove 711. However, the slot 544 develops an axial air gap 544*a*. After insertion of the partition plate 320 into the hollow interior of header pipe 540, an arcuate periphery of the large semicircular portion 321 of partition plate 320 is brazed to the inner peripheral surface of header pipe 540, and an arcuate periphery of small semicircular portion 322 of the partition plate 320 is brazed to both side surfaces 711*b* of groove 711. Thus the partition plate 320 is fixedly disposed within the header pipe 540 while fluid communication between the upper and lower sections 541, 542 through the partition plate 320 is prevented. Also, the heat exchanger is hermetically sealed as refrigerant is prevented from escaping to the atmosphere. The effect of this embodiment is substantially similar to the effect of the first embodiment so that explanation thereof is omitted.

The invention has been described in detail in connection with the preferred embodiments. These embodiments, however, are merely for example only and the invention is not restricted thereto. It will be understood by those skilled in the art that other variations and modifications can easily be made within the scope of this invention as defined by the appended claims.

I claim:

1. In a condenser for a refrigerant fluid circuit comprising first and second header pipes, at least one of said header pipes being provided with at least one partition plate which is inserted into the interior of said at least one header pipe through at least one slot formed through a side surface thereof, a part of a periphery of said at least one partition plate being received in said at least one slot when said at least one partition plate is completely inserted into the interior of said header pipes, the improvement comprising:

said at least one header pipe including at least one supporting portion formed at an inner surface of said at least one header pipe opposite said at least one slot so as to support another part of the periphery of said at least one partition plate opposite to said part of the periphery of said at least one partition plate, said at least one supporting portion being an arcuate groove.

2. The condenser of claim 1 further comprising a heat exchanger including a plurality of tubes having opposite first and second open ends, a plurality of fin units disposed between said plurality of tubes, said first and second header pipes fixedly and hermetically disposed at said opposite ends of said tubes, said open ends of said tubes disposed in fluid communication with the interior of said header pipes.

3. The condenser of claim 1 wherein both said first and second header pipes have a partition plate inserted therein.

4. The condenser of claim 1 wherein said first and second header pipes are cylindrically shaped.

5. The condenser of claim 4 wherein said at least one supporting portion is an arcuate groove.

6. The condenser of claim 4 wherein said at least one partition plate includes a large radius portion and a small radius portion.

7. The condenser of claim 6 wherein said large radius portion of said at least one partition plate is larger than a radius of an inner peripheral surface of said at least one header pipe, and said small radius portion of said at least one partition plate is similar to a radius of a bottom surface of said arcuate groove.

8. The condenser of claim 6 wherein said at least one partition plate includes a large semicircular portion and a small semicircular portion.

9. The condenser of claim 4 wherein said arcuate groove is formed using a die.

10. The condenser of claim 4 wherein said arcuate groove is formed by machining.

11. In a refrigerant circuit comprising a compressor, a condenser, an expansion element, and an evaporator sequentially disposed, said condenser comprising first and second header pipes and a heat exchanging region, at least one of said header pipes including a partition plate inserted therein, said partition plate being partially supported by a slot formed in a side surface of said at least one header pipe and partially supported by a supporting portion formed at an inner surface of said at least one header pipe opposite to said slot, said supporting portion being an arcuate groove.

12. The circuit of claim 11 wherein both said first and second header pipes have a partition plate inserted therein.

13. The circuit of claim 11 wherein said header pipes are cylindrically shaped.

14. The circuit of claim 13 wherein said partition plate includes a large radius portion and a small radius portion.

15. The circuit of claim 14 wherein said large radius portion of said partition plate is larger than a radius of an inner peripheral surface of said header pipe, and said small radius portion of said partition plate is similar to a radius of a bottom surface of said arcuate groove.

16. The circuit of claim 14 wherein said partition plate includes a large semicircular portion and a small semicircular portion.

17. The circuit of claim 13 wherein said arcuate groove is formed using a die.

18. The circuit of claim 13 wherein said arcuate groove is formed by machining.

19. The circuit of claim 13 wherein said supporting portion is an arcuate groove.

20. A header pipe for use in a condenser, said header pipe comprising:

a slot formed in a side surface of said header pipe;

a supporting portion formed at an inner surface of said header pipe opposite said slot; and a partition plate inserted into said slot such that said partition plate is simultaneously supported by said slot and said supporting portion, said supporting portion being an arcuate groove.

21. The header pipe of claim 20 wherein said header pipe is cylindrically shaped.

22. The header pipe of claim 21 wherein said supporting portion is an arcuate groove.

23. The header pipe of claim 21 wherein said partition plate includes a large radius portion and a small radius portion.

24. The header pipe of claim 23 wherein said large radius portion of said partition plate is larger than a radius of an inner peripheral surface of said header pipe, and said small radius portion of said partition plate is similar to a radius of a bottom surface of said arcuate groove.

25. The header pipe of claim 23 wherein said partition plate includes a large semicircular portion and a small semicircular portion.

26. The header pipe of claim 25 wherein said large semicircular portion is brazed to an inner peripheral surface of the header pipe and said small semicircular portion is brazed to said arcuate groove.

27. The header pipe of claim 21 wherein said arcuate groove is formed using a die.

28. The header pipe of claim 21 wherein said arcuate groove is formed by machining.

29. The header pipe of claim 20 wherein said slot includes semicircular flanges.

30. The header pipe of claim 29 wherein a radial protrusion is formed in said header pipe opposite to said slot.

* * * * *